US008747285B2

(12) United States Patent
Hof

(10) Patent No.: US 8,747,285 B2
(45) Date of Patent: Jun. 10, 2014

(54) TRAINING AND/OR REHABILITATION DEVICE IN WHICH A WALKING OR RUNNING TREADMILL IS ARRANGED IN A WATER CONTAINER COMPRISING FLOWING WATER

(76) Inventor: Georg Hof, Purkersdorf (AT)

( * ) Notice: Subject to any disclaimer, the term of this patent is extended or adjusted under 35 U.S.C. 154(b) by 194 days.

(21) Appl. No.: 13/145,298

(22) PCT Filed: Jan. 12, 2010

(86) PCT No.: PCT/AT2010/000008

§ 371 (c)(1),
(2), (4) Date: Oct. 3, 2011

(87) PCT Pub. No.: WO2010/083542

PCT Pub. Date: Jul. 29, 2010

(65) Prior Publication Data

US 2012/0010052 A1 Jan. 12, 2012

(30) Foreign Application Priority Data

Jan. 20, 2009 (AT) ..... GM31/2009

(51) Int. Cl.
*A63B 22/02* (2006.01)
*A63B 22/00* (2006.01)

(52) U.S. Cl.
USPC ..... 482/54; 482/51

(58) Field of Classification Search
USPC ..... 482/54–56, 111–113, 148; 4/488, 491, 4/496; 119/700
See application file for complete search history.

(56) References Cited

U.S. PATENT DOCUMENTS

| | | | | |
|---|---|---|---|---|
| 3,809,003 | A | 5/1974 | Foldvari | |
| 4,001,899 | A * | 1/1977 | Mathis | 4/489 |
| 4,576,376 | A | 3/1986 | Miller | |
| 4,918,766 | A * | 4/1990 | Leonaggeo, Jr. | 4/495 |
| 4,938,469 | A * | 7/1990 | Crandell | 482/54 |
| 5,027,449 | A * | 7/1991 | Teratsuji et al. | 4/488 |
| 5,083,329 | A * | 1/1992 | Murakami | 4/541.4 |
| 5,437,588 | A | 8/1995 | Abboudi | |
| 5,558,604 | A * | 9/1996 | Hopkins | 482/54 |
| 5,690,587 | A * | 11/1997 | Gruenangerl | 482/54 |
| 5,921,892 | A | 7/1999 | Easton | |
| 6,679,812 | B2 * | 1/2004 | Torkelson | 482/51 |
| 7,086,994 | B2 * | 8/2006 | Turak et al. | 482/54 |
| 7,241,250 | B1 * | 7/2007 | French et al. | 482/54 |
| 2004/0259689 | A1 * | 12/2004 | Wilkins et al. | 482/8 |
| 2006/0243217 | A1 * | 11/2006 | Patterson | 119/700 |
| 2008/0016610 | A1 * | 1/2008 | Kuo et al. | 4/488 |
| 2008/0127405 | A1 * | 6/2008 | Hof | 4/496 |
| 2008/0271236 | A1 * | 11/2008 | Truman et al. | 4/541.1 |

FOREIGN PATENT DOCUMENTS

| | | | |
|---|---|---|---|
| DE | 39 11 370 | A1 | 10/1990 |
| DE | 199 63 583 | A1 | 11/2000 |
| DE | 100 01 878 | A1 | 12/2001 |
| DE | 10 2004 010 188 | A1 | 9/2005 |
| JP | 2001-137383 | A | 5/2001 |
| JP | 2001137383 | A * | 5/2001 |

* cited by examiner

*Primary Examiner* — Loan H Thanh
*Assistant Examiner* — Gregory Winter
(74) *Attorney, Agent, or Firm* — Muncy, Geissler, Olds & Lowe, P.C.

(57) ABSTRACT

A training and/or rehabilitation device in which a walking or running treadmill (2) is arranged in a water tank with flowing water (9). To be able to use the device regardless of the design of the water tank, the walking or running treadmill (2) can be used together with a stream generator (3) as a unit in the water tank or in open water.

11 Claims, 1 Drawing Sheet

TRAINING AND/OR REHABILITATION DEVICE IN WHICH A WALKING OR RUNNING TREADMILL IS ARRANGED IN A WATER CONTAINER COMPRISING FLOWING WATER

This application is a national stage of International Application No.: PCT/AT2010/000008, which was filed on Jan. 12, 2010, and which claims priority to Austrian Patent Application No.: GM 31/2009, which was filed in Jan. 20, 2009, and which are both herein incorporated by reference.

BACKGROUND OF THE INVENTION

1. Field of the Invention

The invention relates to a training and/or rehabilitation device in which a walking or running treadmill is arranged in a water tank with flowing water, the walking or running treadmill being arranged together with a stream generator on a common framework, which unit can be used in a water tank or in open water.

2. Description of the Background Art

In known designs of this type, a walking or running treadmill is used in a pool equipped with a stream system, whereby said pool is used primarily for the treatment of animals (see in particular DE 3911370 C2, DE 102004010188 A1, or DE 10001878 A1).

In DE 19963583 A1 as well, which discloses an "Aqua-Trainer for humans," a treadmill is used fixed in a water tank equipped with a stream system or countercurrent swimming unit.

The aforementioned designs have the disadvantage that the walking or running treadmill can be used for underwater therapy in combination with the water flow only when the water pools are provided with appropriate stream systems.

U.S. Pat. No. 4,576,376 shows a treadmill which is placed in a pool and by which a pump can be driven, which draws water out of the pool and returns it into the pool via openings in a riser pipe. The openings in this case are directed against the training person, the water emerging uncontrolled into the pool. The pump is provided to control the running resistance, so that at a high running resistance only a small volume of water is recirculated by the pump.

According to JP 2001137383, a treadmill is used in a pool, whereby a stream generator directed at the lower legs of the person is provided at the hand-hold for the training person; the construction and mode of action of the stream generator is not explained further.

SUMMARY OF THE INVENTION

The object of the invention is to provide a device of the aforementioned type, which can be used independent of the design of the water tank or also in open water, whereby the flow is to be adjustable individually to the training person.

Because the walking or running treadmill is provided with a drive and/or braking device known per se, the drive and/or braking device being connected to a central computer by which both the drive and/or braking device and the stream generator can be controlled, the treadmill speed or the resistance, acting against the user by the treadmill, can be adapted to the treatment or the training stage. This makes it possible, on the one hand, to regulate the belt speed or the belt resistance and, on the other, the flow rate of the water emerging from the stream generator, adjusted to one another and according to the specific requirements. To this end, the control variable for the central computer can be the position of the using person on the walking or running treadmill and/or the belt speed. To determine the position of the using person, sensors can be provided on the walking or running treadmill. For an especially simple design, the sensors can be designed as distance or proximity sensors mounted on the stream generator. This makes it superfluous to place sensors directly under the treadmill, which is disadvantageous, inasmuch as the treadmill slides over the sensors when there is a load. Finally, the incline of the walking or running treadmill can be adjusted to set different load patterns for the training person.

An exemplary embodiment of the subject-matter of the invention is presented schematically in the drawing.

Figure 1:
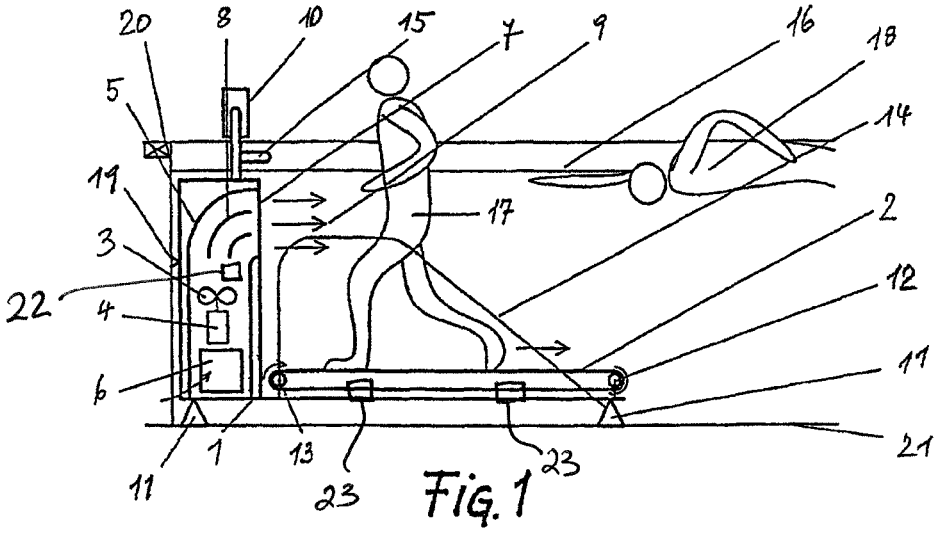
FIG. 1 is a schematic side view, the housing of the stream generator being shown open on the side.
Figure 2:
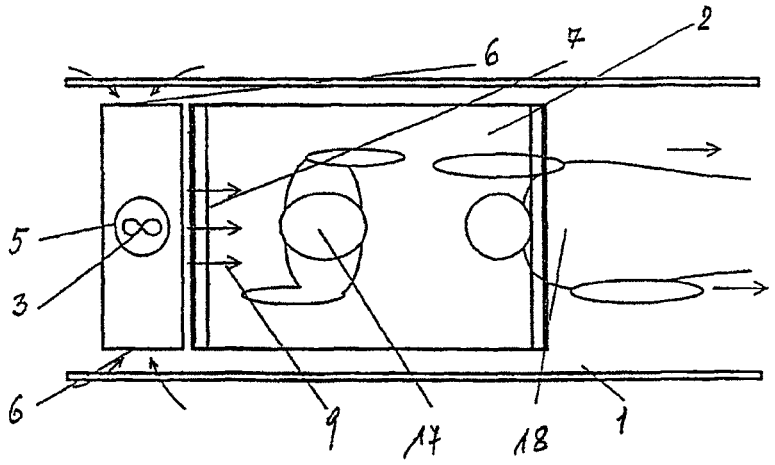
FIG. 2 is a schematic plan view of the design according to FIG. 1.

A walking or running treadmill 2 and a stream generator 3 are arranged on a support frame 1. Stream generator 3 in this case is driven by a turbine 4 and is located in a housing 5, in which the water is drawn in via side intake grates 6. The drawn in water is conveyed into the pool via a discharge nozzle or a discharge passage 7, guide plates 8 diverting the water stream being arranged in housing 5. The flow predominating in the pool is indicated by arrows 9.

Both treadmill 2 and stream generator 3 are connected to a central computer 10, which regulates both treadmill 2 and stream generator 3 as a function of one another or independently of one another. Framework 1 bearing treadmill 2 is supported by adjustable feet 11 at the bottom 21 of the tank. Belt 2 has a deflection roller 12 and a drive and/or braking device 13. Said drive and/or braking device is then used for regulating the device or the load of the person by means of the power of the stream generator. Handgrips are designated with 14 and 15 which a runner 17 can hold for safe movement. Handgrip 14 is located under water line 16, and handgrip 15, in contrast, above the line.

As an alternative to runner 17, the number 18 indicates a swimmer, who uses the training and/or rehabilitation device of the invention for generating a countercurrent for swimming training. In this case, treadmill 2 is not used.

A spacer 19 is provided further on support frame 1 to keep the device at an appropriate distance from the pool edge 20.

The position of runner 17 is typically used to control the device of the invention by the central computer 10, the position measurement being made in a conventional manner, for instance, by a distance or proximity sensor 22, which is mounted on housing 5 of stream generator 3. As an alternative hereto, pressure sensors 23 provided under the treadmill could also be provided, which then determine the position of the runner based on the pressure applied by runner to the treadmill.

In a likewise not shown manner, the treadmill could also be pivotable around the axis of roller 12, in fact, in such a way that drive and/or braking device 13, causing the front deflection of the belt, is pivotable toward the edge of the tank. In this way, an ascent can be simulated by an inclined plane.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A training and/or rehabilitation device comprising:

a walking or running treadmill arranged in a water tank or in open water with flowing water, a stream generator, wherein the walking or running treadmill is arranged together with the stream generator on a common framework, and wherein the common framework, together with the walking or running treadmill and the stream generator, is arranged within the water tank or in the open water, a drive and/or braking device provided for the walking or running treadmill, the drive and/or braking device being connected to a central computer and the stream generator being connected to the central computer, such that both the drive and/or braking device and the stream generator are independently controlled by the central computer, wherein the stream generator is provided within a housing on the common framework, wherein water guide plates that guide a flow of water are provided within the housing, and wherein water is drawn to the stream generator through intake grates that are provided on a side wall of the housing.

2. The training and/or rehabilitation device according to claim 1, wherein a control variable for the central computer is a position of the using person on the walking or running treadmill and/or the belt speed.

3. The training and/or rehabilitation device according to claim 2, wherein to determine the position of the using person, sensors are provided on the walking or running treadmill.

4. The training and/or rehabilitation device according to claim 2, wherein to determine the position of the using person, distance or proximity sensors are mounted on the stream generator.

5. The training and/or rehabilitation device according to claim 1, wherein the incline of the walking or running treadmill is adjustable.

6. The training and/or rehabilitation device according to claim 1, wherein the central computer is attached to the housing of the stream generator, the central computer arranged so as to be positioned above a water line.

7. The training and/or rehabilitation device according to claim 1, wherein when the training and/or rehabilitation device is arranged in the water tank, the housing is surrounded by a spacer that maintains a space between the training and/or rehabilitation device and an edge of the water tank.

8. The training and/or rehabilitation device according to claim 1, wherein the common framework is provided with adjustable feet.

9. The training and/or rehabilitation device according to claim 1, further comprising two handgrips, one of the two handgrips provided above a water line and the second of the two handgrips provided below the water line.

10. The training and/or rehabilitation device according to claim 1, wherein the walking or running treadmill operates independent of operation of the stream generator.

11. The training and/or rehabilitation device according to claim 8, wherein a space is provided between the common framework and a bottom of the water tank or ground of the open water.

* * * * *